US008210808B2

(12) United States Patent
Clarence et al.

(10) Patent No.: US 8,210,808 B2
(45) Date of Patent: Jul. 3, 2012

(54) PUMP INSERT AND ASSEMBLY

(75) Inventors: Nigel P. Clarence, Rochdale (GB); Richard J. Collings, Taunton (GB); Ian H. Wells, Clitheroe (GB)

(73) Assignee: Weir Minerals Europe Limited (GB)

( * ) Notice: Subject to any disclaimer, the term of this patent is extended or adjusted under 35 U.S.C. 154(b) by 859 days.

(21) Appl. No.: 10/579,182

(22) PCT Filed: Nov. 11, 2004

(86) PCT No.: PCT/GB2004/004751
§ 371 (c)(1),
(2), (4) Date: Jan. 22, 2007

(87) PCT Pub. No.: WO2005/052378
PCT Pub. Date: Jun. 9, 2005

(65) Prior Publication Data

US 2007/0201977 A1 Aug. 30, 2007

(30) Foreign Application Priority Data

Nov. 14, 2003 (GB) ..... 0326534.5

(51) Int. Cl.
*F04D 29/62* (2006.01)
*F04D 29/42* (2006.01)

(52) U.S. Cl. ..... 415/214.1; 415/168.2; 415/206; 415/230

(58) Field of Classification Search ..... 415/96, 415/98, 99, 111, 168.2, 172.1, 203, 206, 415/214.1, 229, 230
See application file for complete search history.

(56) References Cited

U.S. PATENT DOCUMENTS

| | | | | | |
|---|---|---|---|---|---|
| 1,881,723 | A | * | 10/1932 | Lee | 415/119 |
| 3,090,319 | A | * | 5/1963 | Stanley | 415/197 |
| 3,146,722 | A | * | 9/1964 | Warman | 415/205 |
| 3,265,002 | A | * | 8/1966 | Warman | 415/197 |
| 4,575,306 | A | * | 3/1986 | Monnot | 415/131 |
| 5,427,498 | A | | 6/1995 | Lehe et al. | |

FOREIGN PATENT DOCUMENTS

| | | |
|---|---|---|
| DE | 19718027 | 11/1998 |
| EP | 0522324 | 1/1993 |
| EP | 0536825 | 9/1993 |
| EP | 1300594 | 4/2003 |
| GB | 589689 | 6/1947 |

* cited by examiner

*Primary Examiner* — Nathaniel Wiehe
(74) *Attorney, Agent, or Firm* — Gifford, Krass, Sprinkle, Anderson & Citkowski, P.C.

(57) ABSTRACT

A pump insert (128) has an inner surface which in use defines a portion of a volute (124) of a pump (110) wherein said pump insert (128) is adapted to be coupled with a pump casing (116) by an inter-engaging profiled coupling arrangement (166). In one disclosed embodiment the pump insert (128) is adapted to engage a pump casing closure plate (148) which is locatable about a pump shaft (112) and between the pump inert (148) and the pump casing (110).

48 Claims, 10 Drawing Sheets

PUMP INSERT AND ASSEMBLY

FIELD OF INVENTION

The present invention relates to an insert for a pump, and in particular, but not exclusively, to an insert which defines a portion of a volute of a centrifugal pump. The present invention also relates to a method of securing an insert within a pump.

BACKGROUND OF INVENTION

Pumps are used in numerous applications for transferring a fluid from one location to another. Various categories of pump are available such as centrifugal, rotodynamic and positive displacement, and the choice of pump type for a particular application depends on a number of factors, such as the duty flow rates and pressure requirements, for example. However, much consideration is additionally given to the suitability or compatibility of the pump with the mechanical and chemical properties of the fluid to be pumped. For example, the fluid may be an abrasive suspension of non-soluble particulate material, generally referred to as slurry. Special pumps, known as slurry pumps are available to be used with such slurry material.

One particular form of slurry pump is a centrifugal slurry pump which includes a casing having a suction branch and a delivery branch, and a shaft extending into the casing and being coupled to an impeller at one end, wherein the impeller is located within a pump volute and/or pump casing. In use, a slurry is drawn into the pump casing through the suction branch and through an eye of the rotating impeller. Energy is imparted to the slurry as it is driven in a radial direction through the impeller, with the slurry being discharged from the pump casing via the delivery branch.

In some centrifugal slurry pumps, such as in some lined pumps, for example, a throatbush may be provided between the suction branch and the pump impeller to provide a flow path for a pump fluid, and to define a portion of a pump volute. Such a throatbush is conventionally clamped in place during assembly, which may require additional clamping inserts or the like to be used.

The shaft extends into the casing through a pump casing closure assembly which generally includes an annular plate insert mounted circumferentially about the shaft, wherein the annular plate insert defines a portion of the pump volute, with the remaining portion of the volute being defined by the casing or a casing liner or the like. Conventionally, the annular plate insert is directly and mechanically fixed to the pump casing by means of a number of studs, one end of which are secured to the annular plate and the other end of which extend through apertures in the casing to be bolted thereto. The presence of these studs increase the difficulty and time required to assemble and disassemble a pump due to the requirement for correct alignment of the studs with the apertures in the casing and the need for tooling to bolt the studs to the casing. Additionally, the studs require that the annular insert plate be drilled and tapped to receive the ends of the studs, and likewise may require that the specific points of attachment of the studs to the annular insert plate be of a soft insert material allowing machining. The insert material is conventionally cast or moulded into a wear resistant material which can be metal or rubber. Furthermore, the studs may be exposed to the pump fluid, or the surrounding environment, resulting in corrosion which may affect the integrity of the studs and may cause the studs to seize together with the pump casing, making disassembly difficult and time consuming.

In conventional pumps, a sealing arrangement is provided in combination with the closure assembly to prevent or at least minimise fluid leakage between the shaft and the casing closure assembly conventionally known as a shaft seal. Various types of sealing arrangement are available for use with centrifugal slurry pumps., such as a centrifugal seal, a gland seal or a mechanical seal, which are briefly discussed below.

A conventional centrifugal seal incorporates an expeller which rotates in unison with the impeller in a chamber separated from the volute by the annular plate insert. The chamber is defined between the annular plate insert and an expeller plate secured or clamped between the casing and the annular plate insert. In use, the expeller acts as a turbine to reduce the pressure of the slurry attempting to escape around the back of the impeller.

A gland seal includes a stuffing box located around the shaft and secured or clamped between the annular plate insert and the casing. A number of soft packing rings are located between the shaft and the stuffing box to inhibit fluid transfer therebetween.

A mechanical seal consists of a stationary and a rotating face pressed together under mechanical and hydraulic pressure to prevent leakage. The mechanical seal is held in place around the shaft by a seal holder which is itself secured or clamped between the annular plate insert and the casing. A further description of the form and operation of the various sealing arrangements will be provided hereinafter.

In each type of seal briefly discussed above, limitations are imposed on the size of sealing arrangement which may be utilised due to the presence of the studs used to secure the annular plate insert to the casing, and thus to clamp or secure the respective sealing component between the plate insert and casing. This is particularly the case in centrifugal type seals wherein the presence of the studs makes it difficult to maintain an effective expeller diameter in relation to the impeller diameter to provide sufficient sealing capability.

It is among objects of the present invention to obviate or at least mitigate the aforementioned and other problems with the prior art.

SUMMARY OF INVENTION

According to a first aspect of the present invention, there is provided a pump insert having an inner surface which in use defines a portion of a pump volute, wherein said pump insert is adapted to be coupled with a pump casing by an interengaging profiled coupling arrangement.

Preferably, a portion of the pump insert is adapted to be secured against a portion of a pump casing closure element.

In one embodiment, the pump insert may be adapted to be clamped between the pump casing and a pump casing closure element during assembly of the pump. Alternatively, the pump insert may be adapted to be clamped between a pump liner and a pump casing closure plate.

Advantageously, in use, the pump insert according to one embodiment of the present invention may be adapted to engage a pump casing closure element or plate which is locatable about the pump shaft and between the pump insert and the pump casing. Advantageously, the closure element may be locatable directly between the pump insert and the pump casing. Alternatively, the closure element may be locatable between the pump insert and a pump casing adaptor plate, wherein the pump casing adaptor plate is secured to the pump casing. Thus, the closure element may be indirectly located between the pump insert and the pump casing.

Advantageously, the pump casing closure element may define a portion of a pump sealing arrangement. In one embodiment the pump closure element may define a portion of a pump shaft sealing arrangement. For example, the closure plate may define an expeller plate, a stuffing box or alternatively a plate for holding a pump shaft seal, such as a mechanical seal, in place. In an alternative embodiment the pump closure element may define a portion of a pump suction branch sealing arrangement.

The pump insert may be adapted to be located adjacent a suction branch of a pump casing. In such an embodiment, the pump insert preferably provides a flow path between the suction branch of a pump casing and a pump impeller. In this embodiment, the pump insert may conventionally be termed a throatbush.

The pump insert may be adapted to be coupled directly with the casing by the inter-engaging profiled coupling arrangement. Alternatively, the pump insert may be adapted to be coupled with a casing adaptor plate by the inter-engaging profiled coupling arrangement, with the casing adaptor plate being secured to the casing. Thus, the pump insert may be adapted to be indirectly coupled with the casing by the inter-engaging profiled coupling arrangement. The casing adaptor plate may be secured to the casing using a stud and bolt arrangement, a clamping arrangement, or otherwise.

In one embodiment of the present invention, the pump insert may be firmly secured with the pump casing by the inter-engaging profiled coupling arrangement. Preferably, the pump insert is alternatively adapted to be loosely coupled or secured with the pump casing by the inter-engaging profiled coupling arrangement, and the pump insert adapted to be firmly secured in place within the pump casing when the pump is fully assembled.

In one embodiment of the present invention, the inter-engaging profiled coupling arrangement comprises at least one coupling element connected to the pump insert and at least one coupling element connected to the pump casing, wherein the respective coupling elements are complementary and are adapted to be engaged to couple the pump insert with the pump casing.

The coupling elements may be complementary teeth or other like members such as bosses, pins or studs or the like or alternatively one coupling element may be a tooth or other like member, and the other coupling element may be a complementary slot or channel or the like adapted to receive the tooth or other like member.

Preferably, a plurality of coupling elements are provided and connected to the pump insert and the pump casing respectively, wherein the coupling elements of the pump insert may be circumferentially arranged and spaced apart, and the coupling elements of the pump casing may be circumferentially arranged and spaced apart to correspond to the coupling elements of the pump insert.

Preferably, the coupling elements of the pump insert are integrally formed therewith. Alternatively, the coupling elements of the pump insert may be formed separately of and subsequently connected or secured to the insert plate.

In one embodiment of the present invention, the coupling elements of the pump casing may be integrally formed therewith. In an alternative embodiment, the coupling elements of the pump casing may be formed separately and subsequently connected or secured to the pump casing. For example, the coupling elements of the pump casing may be integrally formed with a pump casing adaptor plate with the adaptor plate being secured to the pump casing. In this way, and as described above, the pump insert may be secured to the pump casing indirectly via the inter-engaging profiled coupling arrangement. Thus, it should be understood that the coupling elements of the pump casing may be directly or indirectly connected to the pump casing, and further reference to the coupling elements of the pump casing should be understood as such.

Advantageously, the coupling elements of both the pump insert and the pump casing may be located on and extend from a respective element support surface of the pump casing and pump insert. Conveniently, the element support surface of the pump casing may be integrally formed therewith. Alternatively, the element support surface of the pump casing may be formed separately of the pump casing, for example, the element support surface of the pump casing may be formed on a pump casing adaptor plate, which adaptor plate may be secured to the pump casing. Preferably, the element support surface of the pump insert is formed integrally therewith. Alternatively, the element support surface of the pump insert may be formed separately and subsequently secured thereto.

Preferably, the coupling elements of the pump casing and the pump insert extend from their respective element support surface in a radial direction. That is, the coupling elements of the pump casing may extend in a radial direction with respect to the pump casing, and the coupling elements of the pump insert may extend in a radial direction with respect to the pump insert. Preferably, the coupling elements of the pump casing and pump insert extend in opposite radial directions from the respective element support surfaces. In one embodiment, the coupling elements of the pump casing may extend in a radially inward direction, and the coupling elements of the pump insert may extend in a radially outward direction. Alternatively, the coupling elements of the pump casing may extend in a radially outward direction and the coupling elements of the pump insert may extend in a radially inward direction.

Preferably, each coupling element of the pump insert is adapted to slidably engage a respective coupling element of the pump casing. Preferably also, each coupling element of the pump insert includes an engaging surface adapted to engage a corresponding engaging surface of a respective coupling element of the pump casing. Advantageously, each engaging surface of each coupling element of the pump casing and pump insert defines a wedge or helix profile or the like such that when each coupling element of the pump insert is slidably engaged with a respective coupling element of the pump casing in a first direction, the pump insert and the pump casing are drawn together. Additionally, the wedge or helix profile or the like may assist to prevent the coupling elements from being unintentionally disengaged by slidably engaging the respective coupling elements too far in the first direction.

Preferably, the pump insert is coupled with the pump casing by rotationally misaligning the coupling elements of the pump insert and the pump casing, bringing together the pump insert and pump casing, and rotating the pump insert with respect to the pump casing to cause sliding engagement of the coupling elements of the pump casing and pump insert respectively. In an alternative embodiment, the coupling elements of the pump insert may be engaged with the coupling elements of a pump casing adaptor plate, which adaptor plate subsequently being secured to the pump casing. Alternatively further, the coupling elements of the pump casing and pump insert may be rotationally aligned, as required, with the pump casing and pump insert being brought together in the required fashion to engage the coupling elements.

Preferably, the pump insert comprises an annular portion and a cylindrical portion, wherein the cylindrical portion extends substantially perpendicular from an outer surface of the annular portion. Advantageously, the cylindrical portion defines the coupling element support surface of the pump insert.

Conveniently, the pump insert may be adapted for use on both lined and unlined pumps. A lined pump includes a separate insert or liner which, in combination with the pump insert when located in place, defines the volute of the pump within which one or more pump impellers are intended to be located. Thus, the pump insert may be termed a back liner. Lined pumps generally require that the casing be split into two sections which are separated to locate the liner within the casing, with the separate sections of the casing being bolted or otherwise secured together. An unlined pump does not include a separate liner, with the pump volute being defined primarily by an inner surface of the casing in combination with, for example, a pump insert of the present invention when located in place. Unlined pumps generally do not have split casings, and access to the inside of the casing to locate or retrieve any pump components such as an impeller or the like is achieved by removing a pump casing closure assembly.

Conveniently, the inter-engaging profiled coupling arrangement may be defined as a bayonet type fitting.

Preferably, the pump insert plate is adapted for use with a centrifugal pump, such as a centrifugal slurry pump.

According to a second aspect of the present invention, there is provided a method of assembling a portion of a pump including, at least, a casing having a coupling element, a pump insert having a complementary coupling element, and a pump shaft, said method comprising the steps of:

aligning the coupling element of the pump insert with the coupling element of the pump casing; and causing relative rotational motion of the pump insert and the casing to cause the complementary coupling elements to engage and couple the pump insert with the casing.

Conveniently, an inner surface of the pump insert, in use, is adapted to define a portion of a pump volute.

Preferably, a plurality of complementary coupling elements are provided on both the casing and pump insert.

The coupling elements may be complementary teeth or other like members such as bosses, pins or studs or the like or alternatively one coupling element may be a tooth or other like member, and the other coupling element may be a complementary slot or channel adapted to receive the tooth or other like member.

In a preferred embodiment of the present invention, the pump insert is loosely coupled with the pump casing by engagement of the coupling elements.

In one embodiment of the present invention, the coupling elements of the casing are integrally formed therewith such that the pump insert may be directly coupled with the casing. Alternatively, the coupling elements of the casing may be formed separately and subsequently secured thereto such that the pump insert may be indirectly coupled to the casing. For example, the coupling elements may be formed on a pump casing adaptor plate, which adaptor plate may be secured to the casing. Thus, the method may comprise the steps of aligning the coupling elements of the pump insert with those of the pump casing adaptor plate and rotating the pump insert with respect to the adaptor plate to cause the coupling elements to engage, wherein the adaptor plate is subsequently secured to the pump casing.

In one embodiment, the method may further comprise the step of locating a pump casing closure plate between the pump casing and the pump insert prior to engaging the complementary coupling elements of the casing and insert plate. The closure plate may be located between the pump casing and the pump insert, or alternatively between a pump casing adaptor plate and the pump insert prior to the complementary coupling elements being engaged. Advantageously, the pump casing closure plate provides closure to the casing and additionally may define a portion of a pump shaft sealing arrangement.

Advantageously, the closure plate may be located between the casing and the pump insert when used in a lined pump having a split casing. In this embodiment, the method may involve the steps of locating a first portion of a pump casing about the shaft, locating a closure plate and a pump insert about the shaft with the closure plate located between the pump insert and pump casing, and engaging the complementary coupling elements to couple the pump insert with the casing first portion and secure the closure plate between the pump insert and casing. Preferably, the closure plate is loosely secured between the pump insert and the casing. Advantageously, the method further comprises the steps of locating a pump liner within the first portion of the casing and against the pump insert, and securing a second portion of the casing to the first portion such that the liner is forced against the pump insert resulting in the coupling elements being at least partially disengaged or separated and the pump insert being clamped between the liner and the closure plate, and the closure plate being clamped between the pump insert and the first portion of the pump casing.

Conveniently, the closure plate may be located between a pump casing adaptor plate and the pump insert when used in an unlined pump. In this embodiment, the method preferably involves the steps of locating the adaptor plate about the pump shaft, locating the closure plate and the pump insert about the pump shaft with the closure plate being located between the adaptor pate and the pump insert, and engaging the complementary coupling elements to couple the pump insert with the adaptor plate and secure the closure plate between the pump insert and adaptor. Advantageously, the method further comprises the step of securing a pump casing to the adaptor plate such that the closure plate forces the pump insert against the casing resulting in the coupling elements being disengaged or separated and the pump insert being clamped between the casing and the closure plate, and the closure plate being clamped between the pump insert and the pump casing adaptor plate.

In an alternative embodiment, the pump insert may be coupled by the complementary coupling elements to a second portion of a split pump casing prior to the second portion of the pump casing being secured to the first casing portion. In this embodiment, as the parts of the casing are secured together with a liner secured in place, the complementary coupling elements will be disengaged or separated by the pump insert being clamped between the pump liner and the second portion of the casing.

Advantageously, by causing the coupling elements to be disengaged or separated, either by securing portions of a split pump casing together, or by securing the adaptor plate to the casing, the possibility of the coupling elements becoming seized or locked together when the pump is in use is minimised, allowing the coupling elements to be more readily separated during disassembly of the pump.

According to a third aspect of the present invention, there is provided a pump closure assembly comprising:

a pump insert located about a pump shaft and coupled with a pump casing by an inter-engaging profiled coupling arrangement, wherein an inner surface of the pump insert defines a portion of a pump volute; and a pump casing closure element located about the pump shaft, wherein a portion of the pump casing closure element is secured against a portion of an outer surface of the pump insert.

According to a fourth aspect of the present invention, there is provided a pump comprising a pump insert having an inner surface which in use defines a portion of a pump volute, wherein said pump insert is adapted to be coupled with a pump casing by an inter-engaging profiled coupling arrangement.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
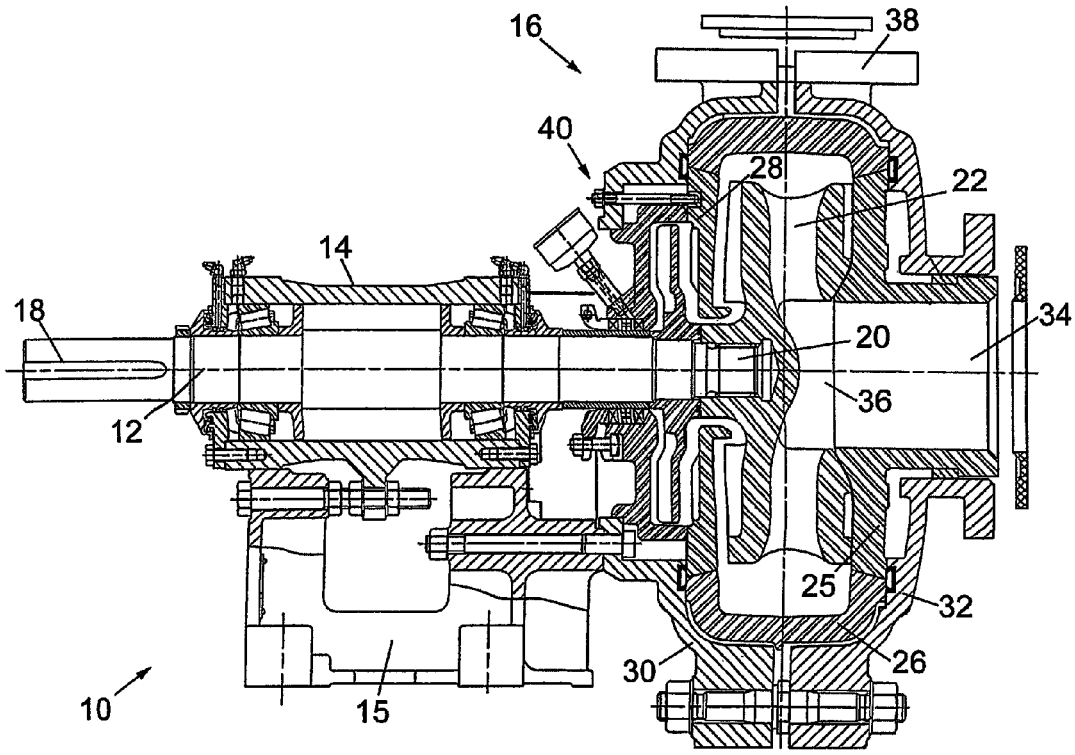
Fig.1 (Prior Art)
FIGS. 1 and 2 are cross-sectional views of a known pump assembly.

Reference is first made to FIG. 1 in which there is shown a cross-sectional view of a known centrifugal slurry pump assembly 10. The assembly 10 includes a shaft 12 rotatably mounted within a bearing housing 14 which is secured to a pump base unit 15, wherein the shaft extends into a pump casing 16 which is also secured to the pump base unit 15. One end 18 of the shaft 12 is adapted to be coupled to drive means such as a motor (not shown), and an opposite end 20 of the shaft 12 is adapted to be coupled to a pump impeller 22. The pump impeller 22 is located within a pump volute which in the assembly 10 of FIG. 1 is defined by a liner insert 26, a liner insert plate 28 and a throatbush 25. In an alternative arrangement (not shown), the volute may be defined by an inner surface of the casing and the liner insert plate. The throatbush 25 is clamped in place within the casing 16 and provides a flow path between a suction branch 34 of the pump casing 16 and an eye 36 of the impeller 22.

In the assembly 10 of FIG. 1, the casing 16 is split into two sections 30, 32 which are assembled and bolted together. This split casing arrangement is typical of lined pumps. However, in unlined pumps, that is, pumps which do not have a separate liner insert, the casing typically is not split.

In use, a slurry is drawn into the suction branch 34 and into the eye 36 of the impeller 22. As the impeller 22 is rotated by the shaft 12 the slurry is driven in a radial direction through the impeller 22, with the slurry being discharged from the pump casing 16 via a delivery branch 38.

The pump assembly 10 includes a shaft seal 40 which provides closure to the pump casing 16 and fluid sealing between the casing 16 and the shaft 12. Various forms of seals are known in the art, such as a centrifugal seal, as shown in FIG. 1, a gland seal or a mechanical seal or the like.

Figure 2:
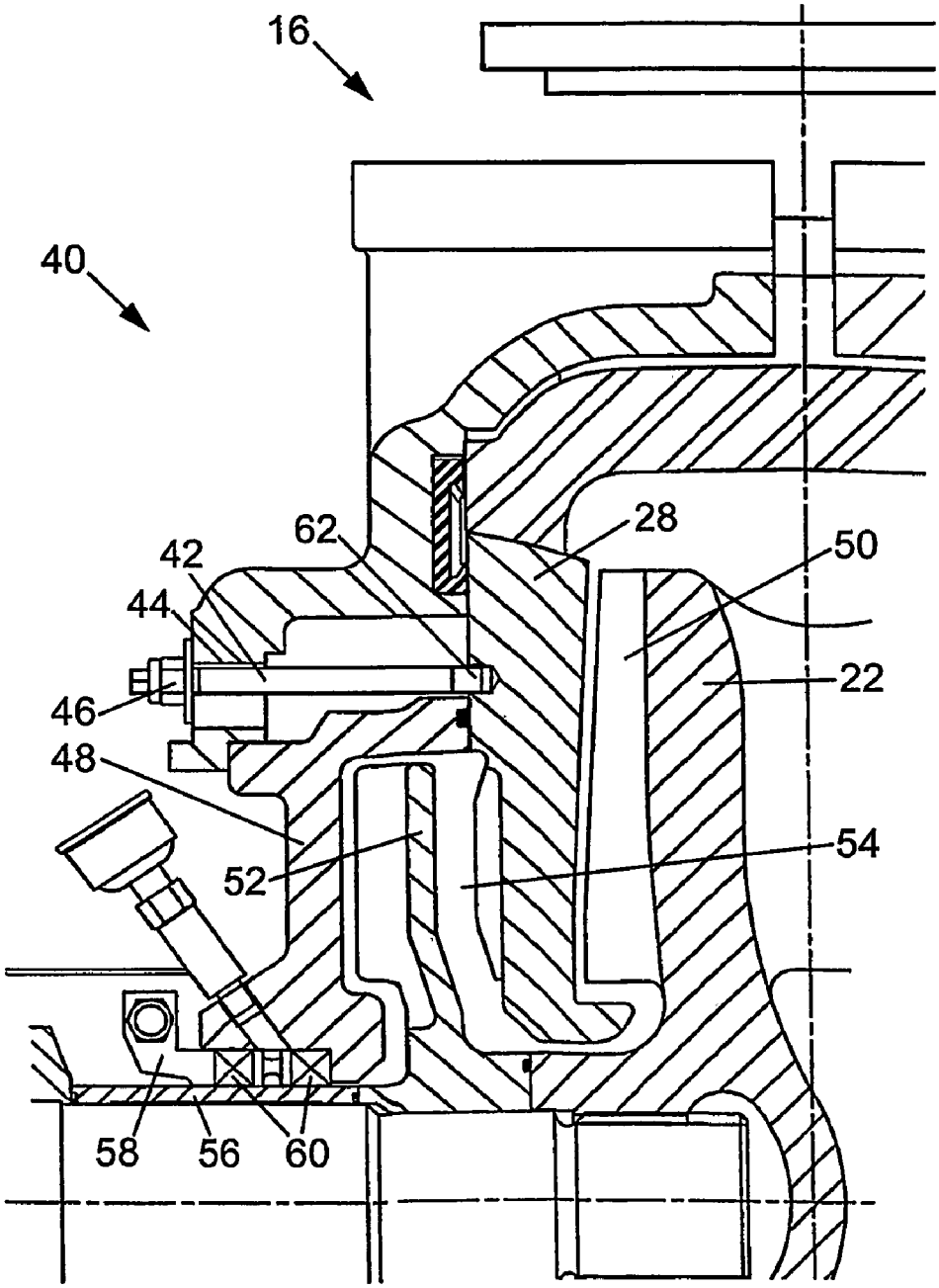
Fig.2 (Prior Art)

An enlarged view of the shaft seal 40, and of the liner insert plate 28 of FIG. 1, is shown in FIG. 2. The liner insert plate 28 is secured to the casing 16 using a plurality of studs 42 (only one shown) which are directly secured to the insert plate 28 and extend through apertures 44 in the casing 16 and are secured thereto using nuts 46. Located and secured between the insert plate 28 and the casing 16 is a pump casing closure plate 48, which when used with a centrifugal seal is generally known as an expeller ring. The centrifugal seal consists of expelling vanes 50 on the back of the impeller 22 and an expeller 52 which rotates in unison with the impeller 22 in a separate chamber 54 defined by the expeller ring 48 and the insert plate 28. The expeller 52 is mounted on the shaft 12 between a shaft sleeve 56 and the impeller 22, which is threaded onto the shaft 12. In use, the expeller 52 acts as a turbine to reduce the pressure of the slurry attempting to escape around the back of the impeller 22. The centrifugal seal is a dynamic, dry seal that only operates whilst the pump is rotating and has no seal effect when the pump is stationary. A secondary seal 58 is therefore provided between the expeller plate 48 and the shaft sleeve 56 to maintain the liquid slurry within the pump when stationary. The secondary seal 58 may include a packing material 60.

As evident from FIG. 2, the presence of the studs 42 restricts the diameter of expeller 52 which may be used, which consequently affects the efficiency and capability of the centrifugal seal. Additionally, the studs 42 increase the difficulty and time required to assemble and disassemble the pump due to the requirement for correct alignment of the studs 42 with apertures 44 and the need for tooling to secure the studs 42 to the casing 16. Additionally, the studs require that the insert plate 28 be drilled and tapped to receive the ends of the studs 42, and likewise may require that the specific points of attachment 62 be cast in a soft insert material allowing machining of an otherwise hard material. In rubber liners the metal skeletons have to be tapped to accommodate the studs. Furthermore, the studs 42 may be exposed to the pump fluid, resulting in corrosion which may affect the integrity of the studs 42 and may cause the studs to seize together with the pump casing 16, making disassembly difficult and time consuming.

Figure 3:
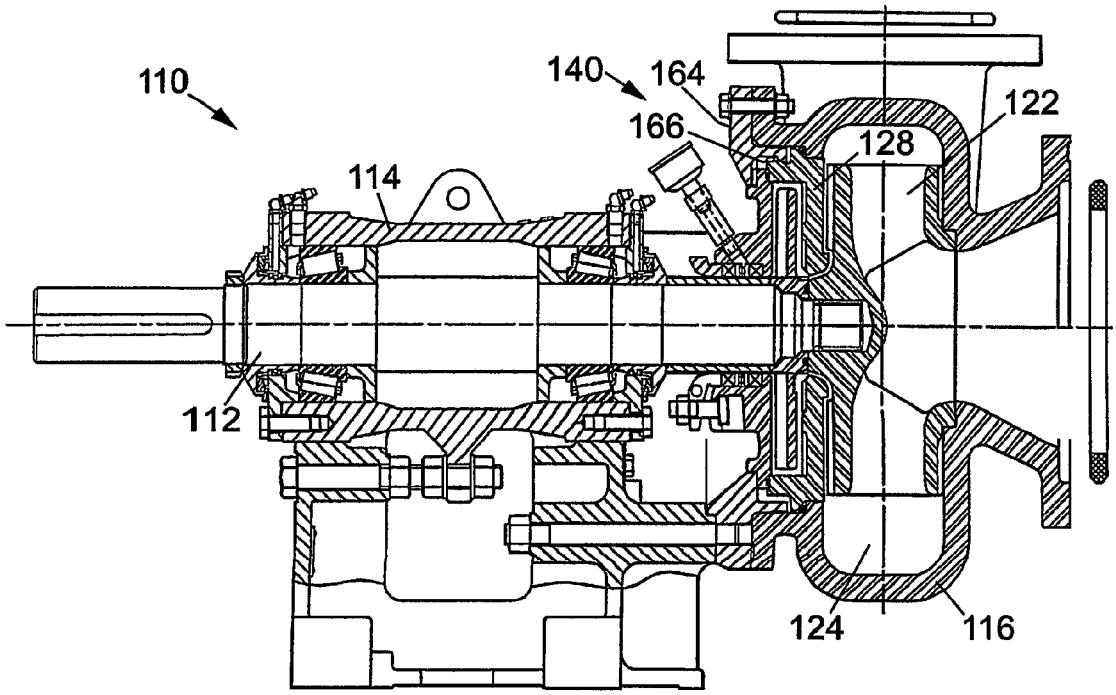
FIGS. 3 and 4 are cross-sectional views of a pump assembly in accordance with an embodiment of the present invention.

Reference is now made to FIG. 3 in which there is shown a cross-sectional view of a pump 110 in accordance with an embodiment of an aspect of the present invention. The general assembly of the pump 110 is similar to the pump 10 of FIGS. 1 and 2 and as such like components share like reference numerals, preceded by a "1". The shaft 112 is mounted within a bearing housing 114 and extends into a pump casing 116, through a shaft seal 140, to engage a pump impeller 122. In the embodiment shown, the casing 116 is complete or non-split, and a pump volute 124 is defined by the casing 116 and a pump insert plate 128. In accordance with the present invention, the pump insert plate is coupled with the pump casing 116, via a pump casing adaptor plate 164 by way of an inter-engaging tooth arrangement 166.

Figure 4:
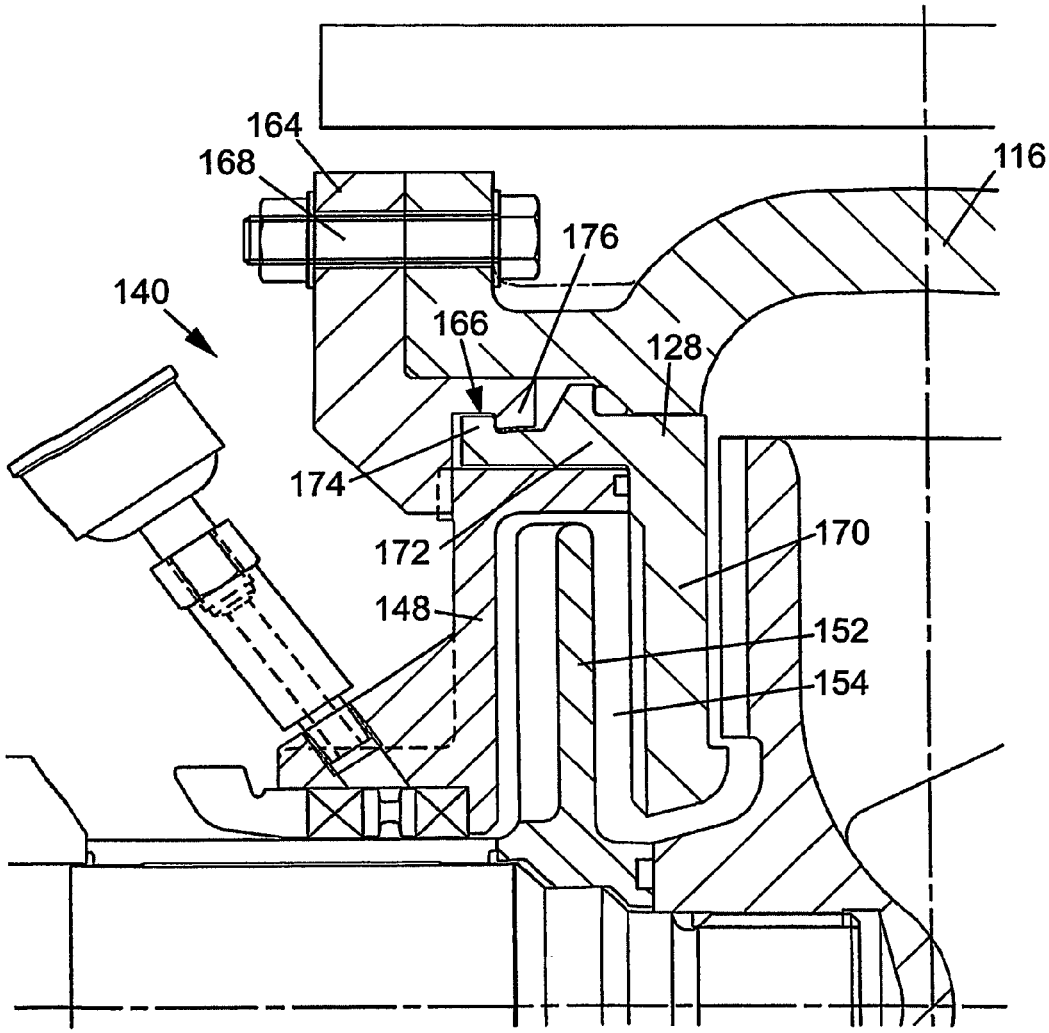

An enlarged view of the closure and sealing assembly 140, and the pump insert plate 128 is shown in FIG. 4. As noted above, the insert plate 128 is coupled with the casing 116 via an adaptor plate 164 by way of an inter-engaging tooth arrangement 166. As shown, the adaptor plate 164 is secured to the casing using studs 168 (only one shown). More specifically, the insert plate 128 includes an annular portion 170 arid a cylindrical portion 172 extending perpendicularly from the annular portion 170, wherein the cylindrical portion 172 supports a plurality of teeth 174 (only one shown) circumferentially distributed about the surface of the cylindrical portion 172. The adaptor plate 164 supports an equal number of complementary teeth 176 which are slidably engaged with teeth 174 of the insert plate 128 to form the inter-engaging tooth arrangement 166 and thus couple the insert plate with the adaptor plate 164, and ultimately with the casing 116.

A closure plate, or in the embodiment shown, an expeller ring 148 is located and secured between the adaptor plate 164 and the insert plate 128. The expeller ring 148, in combination with the insert plate 128 defines a chamber 154 within which an expeller 152 is located. It is evident from FIG. 4 that the elimination of the studs 42 (FIG. 2) by use of an inter-engaging tooth arrangement 166 allows for the use of a larger expeller 152 diameter which consequently provides a better and more efficient fluid seal. Additionally, the inter-engaging tooth arrangement 166 provides a more compact shaft seal 140.

Figure 5:
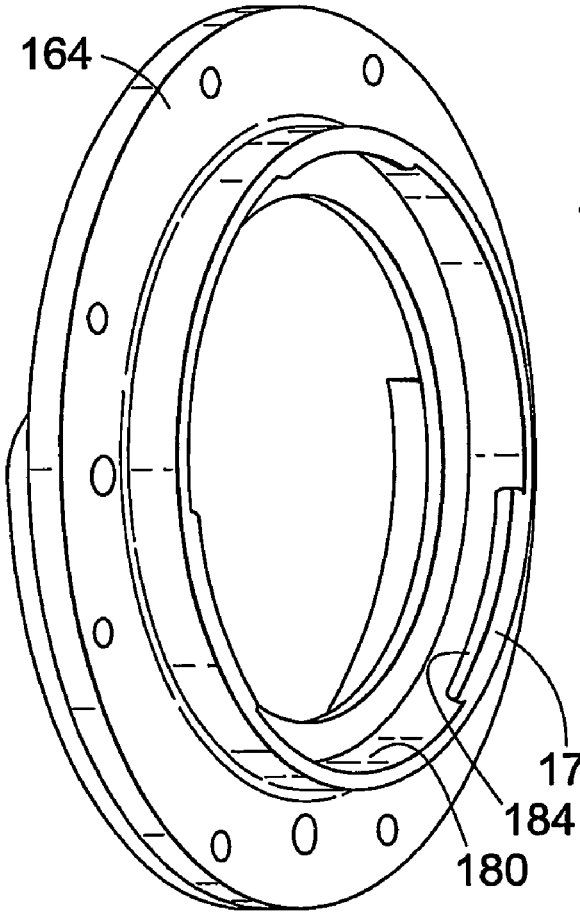
FIGS. 5 and 6 are perspective views of components of the pump assembly of FIGS. 3 and 4 in accordance with an embodiment of the present invention.
Figure 6:
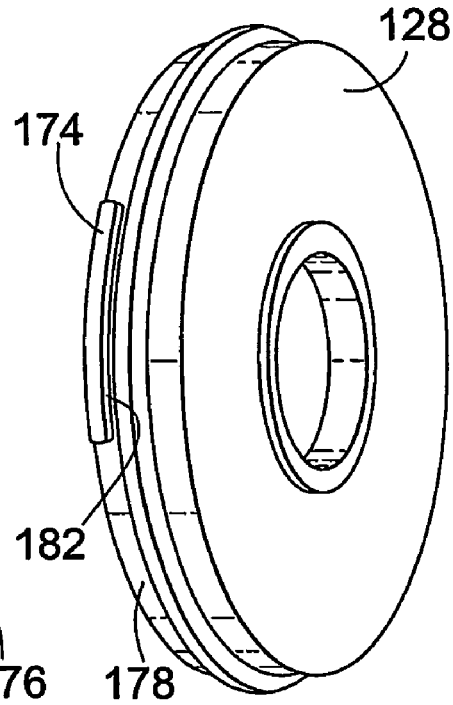

Reference is now made to FIGS. 5 and 6 in which there is shown perspective views of the adaptor plate 164 and insert plate 128, respectively, of FIG. 4. In the embodiment shown, the insert and adaptor plates each include three circumferentially distributed and spaced apart teeth 174, 176. The teeth 174 of the insert plate 128 extend radially outward from a respective tooth support surface 178, and the teeth 176 of the adaptor plate 164 extend radially inwards from a respective tooth support surface 180. Each tooth 174, 176 of the insert and adaptor plates 128, 164 include a respective wedge profiled engaging surface 182, 184. In use, the insert plate 128 is coupled with the adaptor plate 164 by bringing together the plates with the teeth 174, 176 rotationally misaligned, and then rotating one plate relative to the other to cause sliding engagement of the wedge profiles 182, 184 of the teeth, 174, 176. As the teeth 174, 176 are slidably engaged, the wedge profiles 182, 184 cause the plates 128, 164 to be drawn together and substantially prevent excess relative rotation of the plates which would disengage the teeth.

Figure 7:
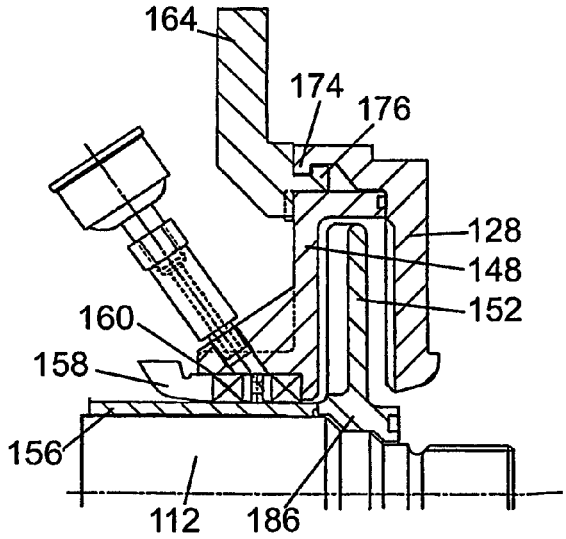
FIGS. 7 and 8 are representations of various stages in assembling a pump in accordance with the present invention.
Figure 8:
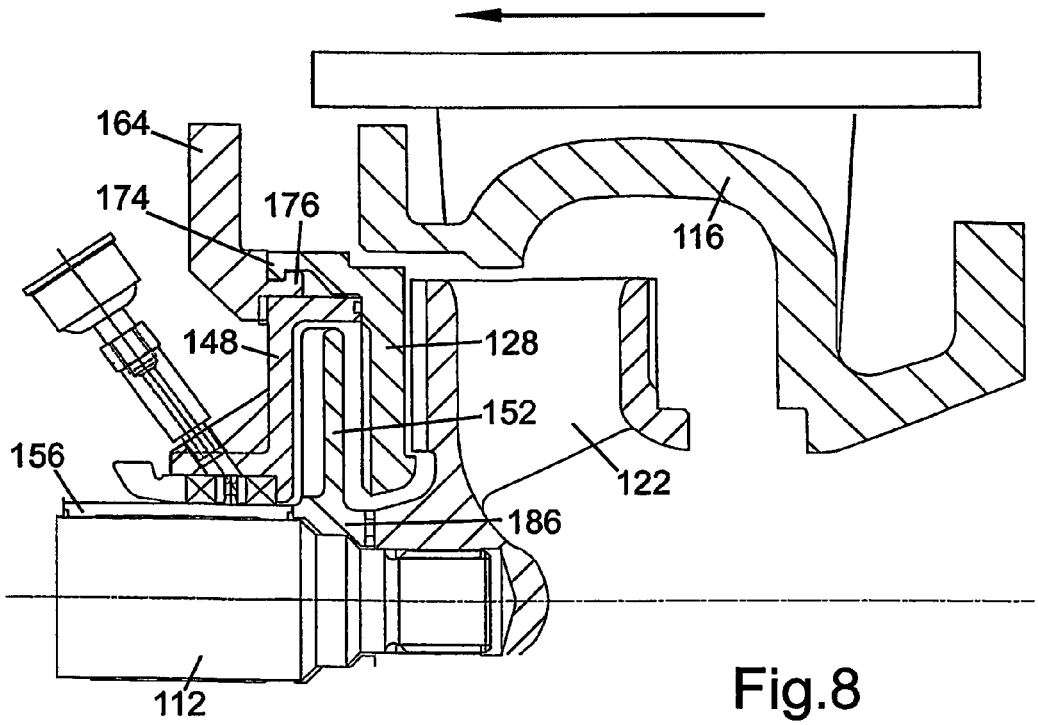

A method of assembling a portion of a pump similar to that shown in FIGS. 3 and 4 is shown in FIGS. 7 and 8, and for the purposes of clarity, like components share like reference numerals as used in FIGS. 3 and 4. It should be noted that the teeth 174, 176 of the insert and adaptor plates 128, 164 shown in FIG. 7 extend in radially opposite directions to that shown in FIGS. 3 to 6, which merely represents an alternative embodiment of the present invention. Referring initially to FIG. 7, a shaft sleeve 156 is located on a shaft 112 and the adaptor plate 164 and expeller ring 148 are located about the shaft 112 and shaft sleeve 156, with a secondary seal 158 with suitable packing material 160 being located between the expeller ring 148 and shaft sleeve 156. The expeller 152 is then mounted on the shaft such that one side of a hub 186 of the expeller 152 abuts an end face of the shaft sleeve. The insert plate 128 is then coupled with the adaptor plate 164, as described above with reference to FIGS. 5 and 6, such that the expeller plate 148 is retained between the adaptor plate 164 and insert plate 128.

Coupling the insert plate 128 to the adaptor plate 164 in this manner is advantageous in that the requirement for studs is eliminated which in turn eliminates the difficulties and time required during assembly. For example, the teeth 174, 176 do not require accurate alignment, as do studs with appropriate apertures. Additionally, the teeth 174, 176 allow the insert plate 128, expeller ring 148 and adaptor plate 164 to be coupled or secured together without using any tooling.

The subsequent assembly steps are shown in FIG. 8, wherein an impeller 122 is threadably coupled to the shaft 112 and clamps the expeller hub 186 between the impeller 122 and the shaft sleeve 156. Once the impeller 122 is secured, the casing 116 is slid over the impeller 122 and the insert plate 128, with the casing then being secured by a bolting arrangement (not shown) to the adaptor plate 164. As the casing 116 becomes secured to the adaptor plate 164, the insert plate 128 becomes securely clamped between the casing 116 and the expeller ring 148, and the expeller ring becomes securely clamped between the insert plate 128 and adaptor plate 164. Additionally, as the casing 116 and adaptor plate 164 are secured, the resulting clamping of the expeller ring 148 and insert plate 128 between the casing and adaptor plate results in the teeth 174, 176 becoming disengaged or separated. This is particularly advantageous as the possibility of the teeth engaging surfaces 182, 186 (FIGS. 5 and 6) becoming corroded and seizing together and thus making disassembly difficult, is substantially reduced.

Figure 9:
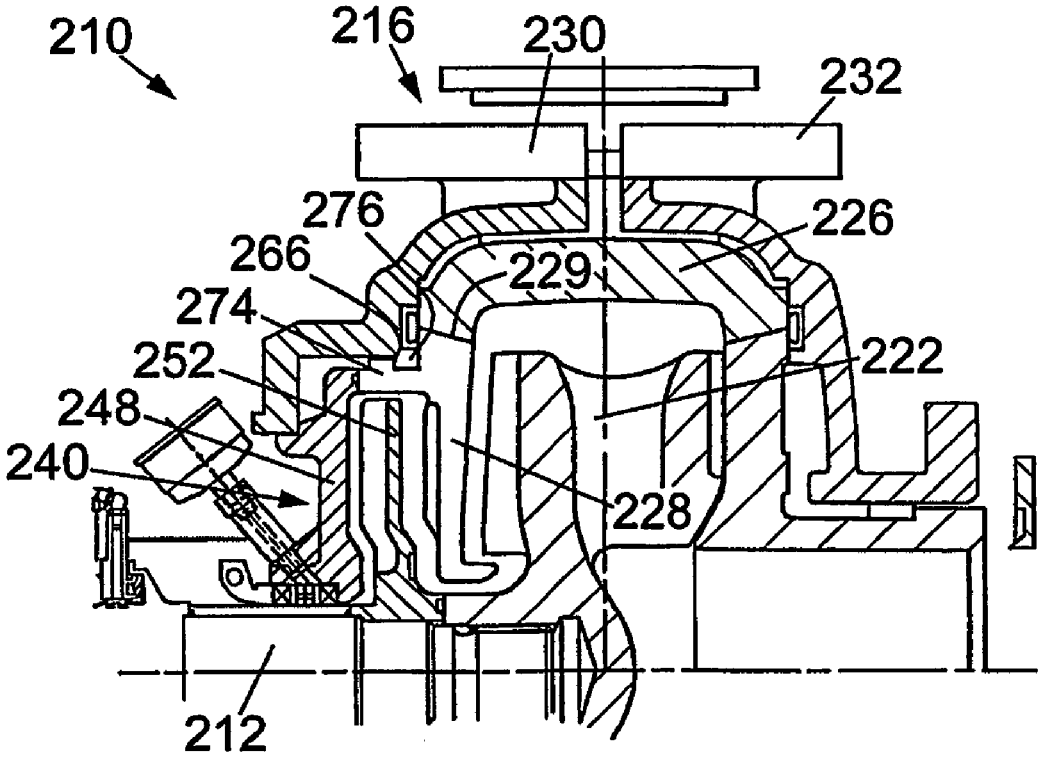
FIGS. 9 to 12 are cross-sectional views of pump assemblies in accordance with alternative embodiments of the present invention.

Reference is now made to FIG. 9 in which there is shown a cross-sectional view of a portion of a pump 210 in accordance with an alternative embodiment of the present invention. The pump 210 includes features similar to those of pump 110 of FIGS. 3 to 8, and as such reference numerals of like components which were previously preceded by a "1", are now preceded by a "2". A shaft 212 extends into a pump casing 216 and supports an impeller 222, wherein the impeller 222 is located within a pump volute defined, at least partially, by a liner insert 226 and an insert plate 228. As shown, the casing 216 is split into two portions, 230, 232. The insert plate 228 is coupled directly with the casing 216 by an inter-engaging tooth arrangement 266, which includes complementary teeth 274, 276 which are similar in form to teeth 174, 176 of FIGS. 4, 5 and 6, and as such will not be described in any further detail.

The pump 210 includes a shaft seal 240 which consists of a centrifugal type seal having an expeller ring 248 and an expeller 252. During assembly, casing portion 230, expeller ring 248 and expeller 252 are located about the shaft 212 in the order shown. The insert plate is then coupled with casing portion 230 by way of the inter-engaging tooth arrangement 266 such that the expeller ring 248 is located between the insert plate and the casing. The subsequent step involves securing the impeller 222 to the shaft 212 and then locating the liner insert 226 about the impeller 22, and subsequently securing the two portions 230, 232 of the casing 216 together. As the separate portions 230, 232 of the casing 216 are secured together, the liner insert 226 is forced against the insert plate 228 at a contact face, generally indicated by reference numeral 229, such that the expeller plate 248 is securely clamped between the insert plate 228 and the casing 216. Additionally, as the liner insert 226 is forced against the insert plate 228, the teeth 274, 276 of the inter-engaging tooth arrangement 266 become disengaged.

Figure 10:
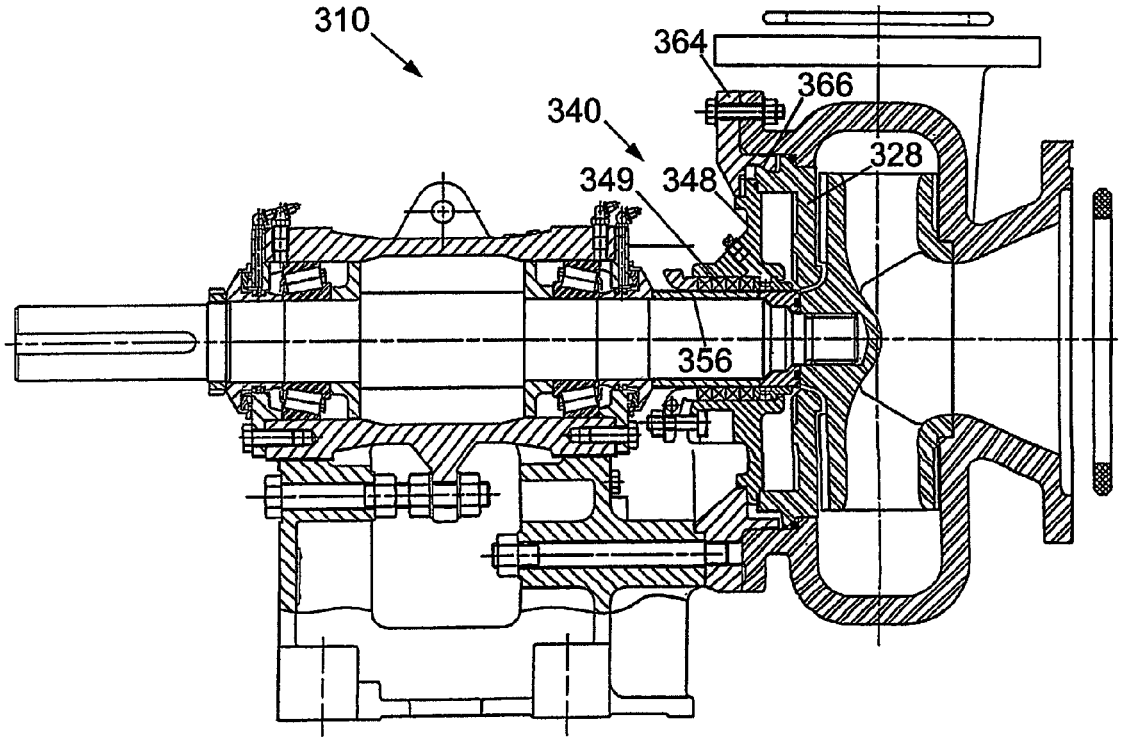

A cross-sectional view of an alternative pump assembly 310, in accordance with an embodiment of the present invention is shown in FIG. 10. Pump assembly 310 is similar in form to the pump assembly 110 of FIGS. 3 to 6, and as such reference numerals of like components preceded with a "1" in FIGS. 3 to 6, are now preceded with a "3". The pump assembly 310 includes an insert plate 328 which is secured to an adaptor plate 364 by way of an inter-engaging tooth arrangement 366. The tooth arrangement 366 is similar to that shown in FIGS. 3 to 6 and as such no further detailed description will be given. The pump assembly 310 includes a shaft seal 340 which differs from that arrangement 140 of FIGS. 3 and 4 in that a gland seal is used in place of a centrifugal seal. In the embodiment of FIG. 10, the shaft seal 340 includes a closure plate 348, which when used with a gland seal may be termed a stuffing box. The gland seal comprises a number of soft packing rings 349 which are compressed between the stuffing box 348 and a protective wear shaft sleeve 356. The stuffing box 348 is located and secured in place between the insert plate 328 and the adaptor plate 364 in similar fashion to the expeller plate 148 shown in FIG. 4.

Figure 11:
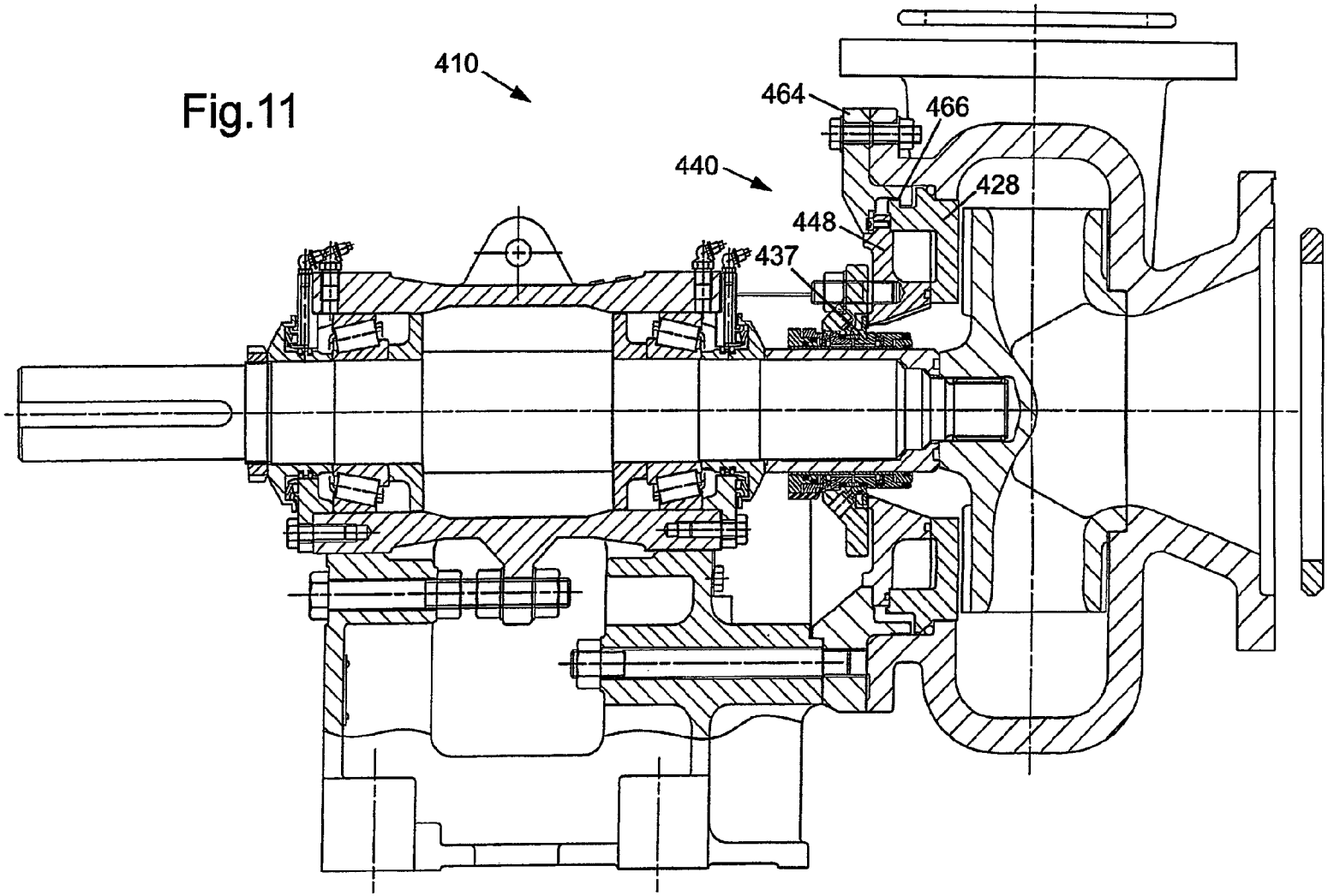

A further alternative embodiment of a pump assembly 410 in accordance with the present invention is shown in cross-section in FIG. 11. In this embodiment, the assembly 410 is similar to that of FIGS. 3 to 6 and as such like components previously identified with reference numerals preceded with a "1", are now preceded with a "4". The pump assembly 410 includes an insert plate 428 which is secured to an adaptor plate 464 by way of an inter-engaging tooth arrangement 466. The tooth arrangement 466 is similar to that shown in FIGS. 3 to 6 and as such no further detailed description will be given. The pump assembly 410 includes a shaft seal 440 which differs from that arrangement 140 of FIGS. 3 and 4 in that a mechanical seal is used in place of a centrifugal seal. In the embodiment of FIG. 11, the shaft seal 440 includes a closure plate 448 which holds a mechanical seal 437 in place.

Figure 12:
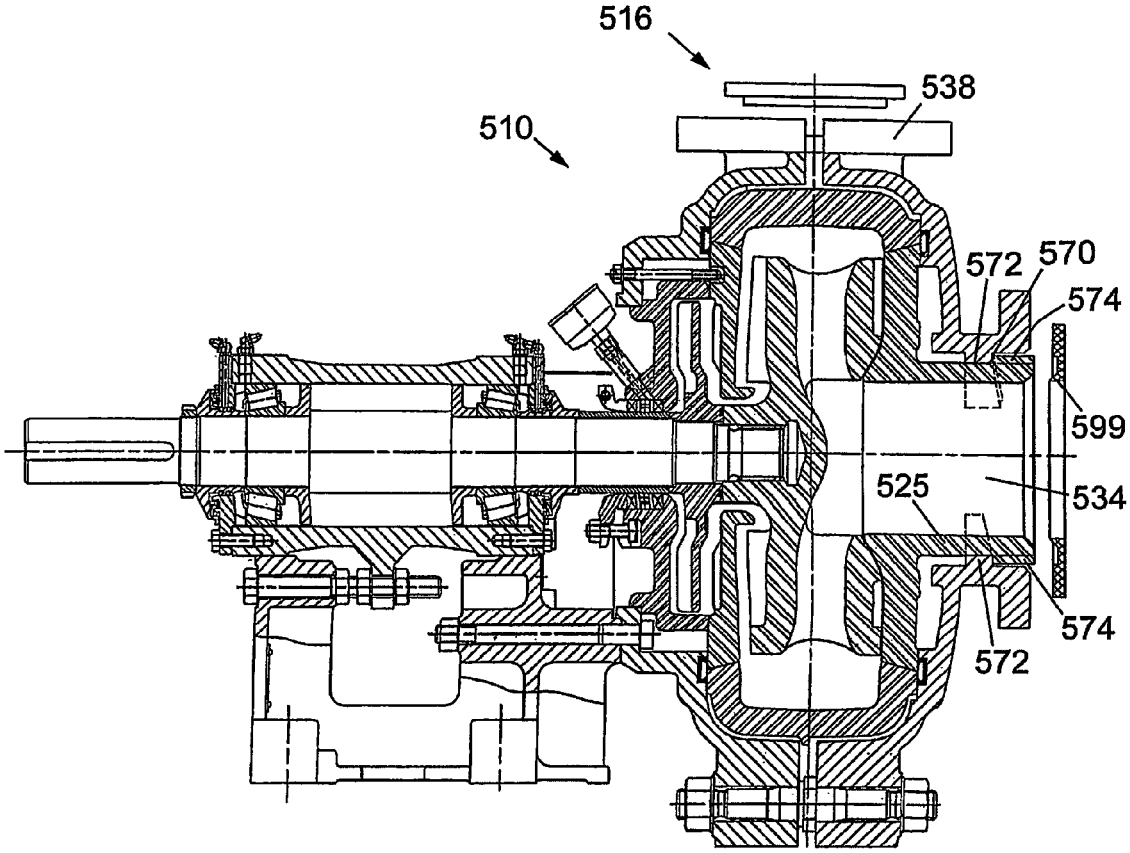

Another embodiment of a pump assembly 510 according to the present invention is shown in cross-section in FIG. 12. In this embodiment, the assembly 510 is similar to that shown in FIGS. 1 and 2 and as such like components share like reference numerals, preceded by a "5". As shown, a throatbush 525 is coupled with a portion 538 of a pump casing 516 by way of an inter-engaging tooth arrangement 570. The inter-engaging tooth arrangement 570 is defined by a number of teeth 572 located on the portion 538 of the casing 516, and an equal number of teeth 574 located on the throatbush 525. The form and method of engaging the inter-engaging tooth arrangement 570 is similar to that arrangement 166 of FIGS. 3 to 8, 266 of FIG. 9, 366 of FIG. 10, and 466 of FIG. 11, and as such no further detailed description will be given.

In use, the suction branch 534 of the pump 510 is coupled to a fluid supply ducting or pipework (not shown). An intake joint 599 is provided as a pump closure element which is secured against a portion of an outer surface of the throatbush 525. The intake joint 599 assists to provide closure to the pump 510 and to provide a fluid seal.

It should be understood that the embodiments described herein are merely exemplary of the present invention and that various modifications may be made thereto without departing from the scope of the present invention. For example, any number of inter-engaging teeth on an insert plate or throatbush and an adaptor plate/casing may be used. Additionally, the specific embodiments shown in FIGS. 10 and 11 may be adapted for use with a pump which has an insert liner and a split casing. Furthermore, alternative embodiments may use a combination of teeth and slots and the like to couple the insert plate with either the casing directly, or indirectly via an adaptor plate. Additionally, a pump assembly may include both a liner insert plate and a throatbush secured with the pump casing by an inter-engaging tooth arrangement.

The invention claimed is:

1. A pump insert to be located within a pump casing and having an inner surface which in use defines a portion of a pump volute, wherein said pump insert is adapted to be coupled with a pump casing by an inter-engaging profiled coupling arrangement, and wherein said pump insert, in use, is adapted to secure a pump casing closure element between the pump insert and the pump casing, and said pump insert is adapted to be clamped between the pump casing and the pump casing closure element during assembly of the pump.

2. A pump insert as claimed in claim 1, wherein a portion of the pump insert is adapted to be secured against a portion of the pump casing closure element.

3. A pump insert as claimed in claim 1, wherein the pump insert is adapted to be clamped between a pump liner and the pump casing closure element.

4. A pump insert as claimed in claim 1, wherein the pump casing closure element is locatable about the pump shaft.

5. A pump insert as claimed in claim 1, wherein the closure element is locatable directly between the pump insert and the pump casing.

6. A pump insert as claimed in claim 1, wherein the closure element is locatable between the pump insert and a pump casing adaptor plate, wherein the pump casing adaptor plate is secured to the pump casing.

7. A pump insert as claimed in claim 1, wherein the pump insert is adapted to be coupled directly with the casing by the inter-engaging profiled coupling arrangement.

8. A pump insert as claimed in claim 6, wherein the pump insert is adapted to be coupled with the pump casing adaptor plate by the inter-engaging profiled coupling arrangement.

9. A pump insert as claimed in claim 1, wherein the pump closure element defines a portion of a pump shaft sealing arrangement.

10. A pump insert as claimed in claim 1, wherein the pump insert is firmly secured with the pump casing by the inter-engaging profiled coupling arrangement.

11. A pump insert as claimed in claim 1, wherein the pump insert is adapted to be loosely coupled with the pump casing by the inter-engaging profiled coupling arrangement, and the pump insert adapted to be firmly secured in place within the pump casing when the pump is fully assembled.

12. A pump insert as claimed in claim 1, wherein the inter-engaging profiled coupling arrangement comprises at least one coupling element connected to the pump insert and at least one coupling element connected to the pump casing, wherein the respective coupling elements are complementary and are adapted to be engaged to couple the pump insert with the pump casing.

13. A pump insert as claimed in claim 12, wherein the coupling elements are complementary teeth.

14. A pump insert as claimed in claim 13, wherein one coupling element is a tooth, and the other coupling element is a complementary slot adapted to receive the tooth.

15. A pump insert as claimed in claim 12, wherein a plurality of coupling elements are provided.

16. A pump insert as claimed in claim 12, wherein the coupling elements of the pump insert are integrally formed therewith.

17. A pump insert as claimed in claim 12, wherein the coupling elements of the pump insert are formed separately of and subsequently connected to the pump insert.

18. A pump insert as claimed in claim 12, wherein the coupling elements of the pump casing are integrally formed therewith.

19. A pump insert as claimed in claim 12, wherein the coupling elements of the pump casing are formed separately and subsequently connected to the pump casing.

20. A pump insert as claimed in claim 19, wherein the coupling elements of the pump casing are integrally formed with a pump casing adaptor plate with the adaptor plate being secured to the pump casing.

21. A pump insert as claimed in claim 12, wherein the coupling elements of both the pump insert and the pump casing are located on and extend from a respective element support surface of the pump casing and pump insert.

22. A pump insert as claimed in claim 21, wherein the coupling elements of the pump casing and the pump insert extend from their respective element support surface in a radial direction.

23. A pump insert as claimed in claim 21, wherein the coupling elements of the pump casing pump insert extend in opposite radial directions from the respective element support surfaces.

24. A pump insert as claimed in claim 12, wherein each coupling element of the pump insert is adapted to slidably engage a respective coupling element of the pump casing.

25. A pump insert as claimed in claim 12, wherein each coupling element of the pump insert includes an engaging surface adapted to engage a corresponding engaging surface of a respective coupling element of the pump casing.

26. A pump insert as claimed in claim 25, wherein each engaging surface of each coupling element of the pump casing and pump insert defines a wedge profile.

27. A pump insert as claimed in claim 12, wherein the pump insert is coupled with the pump casing by rotationally misaligning the coupling elements of the pump insert and the pump casing, bringing together the pump insert and pump casing, and rotating the pump insert with respect to the pump casing to cause sliding engagement of the coupling elements of the pump casing and pump insert respectively.

28. A pump insert as claimed in claim 12, wherein the coupling elements of the pump insert is engaged with the coupling elements of a pump casing adaptor plate, which adaptor plate subsequently being secured to the pump casing.

29. A pump insert as claimed in claim 12, wherein the coupling elements of the pump casing and pump insert are rotationally aligned, as required, with the pump casing and pump insert being brought together in the required fashion to engage the coupling elements.

30. A pump insert as claimed in claim 1, wherein the pump insert comprises an annular portion and a cylindrical portion, wherein the cylindrical portion extends substantially perpendicular from an outer surface of the annular portion.

31. A pump insert as claimed in claim 30, wherein the interengaging profiled coupling arrangement comprises at least one coupling element connected to the pump insert and at least one coupling element connected to the pump casing, wherein the respective coupling elements are complementary and are adapted to be engaged to couple the pump insert with the pump casing, the coupling elements extending from a respective element support surface of the pump casing and pump insert, wherein the cylindrical portion defines the coupling element support surface of the pump insert.

32. A pump insert as claimed in claim 1, wherein the pump insert is adapted for use on both lined and unlined pumps.

33. A pump insert as claimed in claim 1, wherein the inter-engaging profiled coupling arrangement is a bayonet type fitting.

34. A pump insert as claimed in claim 1, wherein the pump insert is adapted for use with a centrifugal pump.

35. A method of assembling a portion of a pump including, at least, a casing having a coupling element, a pump insert having a complementary coupling element, and a pump casing closure element, said method comprising the steps of:

locating the pump casing closure element between the casing and the pump insert;

aligning the coupling element of the pump insert with the coupling element of the pump casing; and causing relative rotational motion of the pump insert and the casing to cause the complementary coupling elements to clamp the pump insert between the pump casing and the pump casing closure element.

36. A method of assembling a portion of a pump as claimed in claim 35, wherein the pump insert is loosely coupled with the pump casing by engagement of the coupling elements.

37. A method of assembling a portion of a pump as claimed claim 35, wherein the method comprises the steps of:

locating the pump casing closure element between the pump insert and a pump casing adaptor plate; and aligning the coupling elements of the pump insert with complementary coupling elements of a pump casing adaptor plate and rotating the pump insert with respect to the adaptor plate to cause the coupling elements to engage, wherein the adaptor plate is subsequently secured to the pump casing.

38. A method of assembling a portion of a pump as claimed in claim 35, wherein the closure element is located between the casing and the pump insert when used in a lined pump having a split casing, such that the method involves the steps of locating a first portion of a pump casing about a shaft, locating a closure element and a pump insert about the shaft with the closure element located between the pump insert and pump casing, and engaging the complementary coupling elements to couple the pump insert with the casing first portion and secure the closure element between the pump insert and casing.

39. A method of assembling a portion of a pump as claimed in claim 38, wherein the closure element is loosely secured between the pump insert and the casing.

40. A method of assembling a portion of a pump as claimed in claim 38, wherein the method further comprises the steps of locating a pump liner within the first portion of the casing and against the pump insert, and securing a second portion of the casing to the first portion such that the liner is forced against the pump insert resulting in the coupling elements being at least partially separated and the pump insert being clamped between the liner and the closure element, and the closure element being clamped between the pump insert and the first portion of the pump casing.

41. A method of assembling a portion of a pump as claimed in claim 35, wherein the closure element is located between a pump casing adaptor plate and the pump insert when used in an unlined pump, such that the method involves the steps of locating the adaptor plate about a pump shaft, locating the closure element and the pump insert about the pump shaft with the closure element being located between the adaptor pate and the pump insert, and engaging the complementary coupling elements to couple the pump insert with the adaptor plate and secure the closure element between the pump insert and adaptor plate.

42. A method of assembling a portion of a pump as claimed in claim 41, the method further comprises the step of securing a pump casing to the adaptor plate such that the closure element forces the pump insert against the casing resulting in the coupling elements being separated and the pump insert being clamped between the casing and the closure element, and the closure element being clamped between the pump insert and the pump casing adaptor plate.

43. A pump closure assembly comprising:

a pump insert located about a pump shaft and coupled with a pump casing by an inter-engaging profiled coupling arrangement, wherein an inner surface of the pump insert defines a portion of a pump volute; and a pump casing closure element located about the pump shaft and secured between the pump insert and the pump casing when said pump insert and pump casing are coupled together by the inter-engaging profiled coupling arrangement;

wherein said pump insert is adapted to be clamped between the pump casing and the pump casing closure element during assembly of the pump.

44. A pump closure assembly as claimed in claim 43, wherein the closure element is directly secured between the pump insert and the pump casing.

45. A pump closure assembly as claimed in claim 43, wherein the closure element is secured between the pump insert and a pump casing adaptor plate which is adapted to be secured to the pump casing.

46. A pump comprising:

a pump casing;

a pump insert located within the pump casing and having an inner surface which in use defines a portion of a pump volute, wherein said pump insert is adapted to be coupled with a pump casing by an inter-engaging profiled coupling arrangement; and a pump closure element secured between the pump insert and the pump casing;

wherein said pump insert is adapted to be clamped between the pump casing and the pump casing closure element during assembly of the pump.

47. A pump as claimed in claim 46, wherein the closure element is directly secured between the pump insert and the pump casing.

48. A pump as claimed in claim 46, further comprising a pump casing adaptor plate adapted to be secured to the pump casing, wherein the pump insert is adapted to be coupled with the adaptor plate by the inter-engaging profiled coupling arrangement with the pump closure element secured therebetween.

* * * * *